US006008613A

United States Patent [19]

Baader

[11] Patent Number: 6,008,613

[45] Date of Patent: Dec. 28, 1999

[54] METHOD FOR CONTROLLING A CROSSWINDING DEVICE

[75] Inventor: Uwe Baader, Wuppertal, Germany

[73] Assignee: Barmag AG, Remscheid, Germany

[21] Appl. No.: 09/194,103

[22] PCT Filed: Mar. 16, 1998

[86] PCT No.: PCT/EP98/01504

§ 371 Date: Nov. 20, 1998

§ 102(e) Date: Nov. 20, 1998

[87] PCT Pub. No.: WO98/42606

PCT Pub. Date: Oct. 1, 1998

[30] Foreign Application Priority Data

Mar. 20, 1997 [DE] Germany ..... 197 11 546

[51] Int. Cl.[6] ..... G05B 19/40

[52] U.S. Cl. ..... 318/685; 242/477.5

[58] Field of Search ..... 318/6, 432, 434, 318/609, 685; 242/225, 249, 250, 389, 390.6, 477.5, 477.6; 57/352, 359

[56] References Cited

U.S. PATENT DOCUMENTS

| | | | |
|---|---|---|---|
| 3,945,581 | 3/1976 | Schippers et al. | 242/43 |
| 4,320,330 | 3/1982 | Bahr et al. | 318/685 |
| 4,336,484 | 6/1982 | Marinko | 318/696 |
| 4,437,619 | 3/1984 | Cary et al. | 242/75.51 |
| 4,928,050 | 5/1990 | Torisawa et al. | 318/696 |
| 5,097,189 | 3/1992 | Ito et al. | 318/685 |

FOREIGN PATENT DOCUMENTS

| | | |
|---|---|---|
| 0 453 622 | 10/1991 | European Pat. Off. . |
| 89 15 275 | 2/1990 | Germany . |
| 296 16 651 | 1/1998 | Germany . |

OTHER PUBLICATIONS

Database WPI Section EI, Week 7533, Derwent Publications Ltd., London, GB; Class V06, An 75–J3126W XP002075582 & NL 7 502 709 A (VDO Schindling AG Adolf), siehe Zusammenfassung, Jul. 31, 1978.

Patent Abstracts of Japan vol. 013, No. 106 (E–726), Mar. 14, 1989 & JP 63 277495 A (Oki Electric Ind Co Ltd), Nov. 15, 1988, siehe Zusammenfassung.

*Primary Examiner*—Robert E. Nappi
*Assistant Examiner*—Rina I. Duda
*Attorney, Agent, or Firm*—Alston & Bird LLP

[57] ABSTRACT

The invention concerns both a method for controlling a traversing device driven by a stepping motor and a traversing device, in which the position of a traversing thread guide which is moved to and fro within a traversing stroke is determined by the position of a rotor of the stepping motor, the rotor moving within a stator of the stepping motor with several windings. The movement of the rotor is controlled, according to the invention, by a stator flux which is determined by a stator voltage generated by means of a flux control device.

13 Claims, 4 Drawing Sheets

METHOD FOR CONTROLLING A CROSSWINDING DEVICE

The invention concerns both a method for controlling a traversing device driven by means of a stepping motor according to the pre-characterizing clause of claim 1 and a traversing device according to the pre-characterizing clause of claim 11.

Such a method and such a device are known from EP 0 453 622, in which a traversing thread guide of a traversing device is driven by a stepping motor for the purpose of laying a thread. In order that the thread guide is driven back and forth within a traversing stroke, the movement of the rotor of the stepping motor is transmitted directly to the thread guide. In this case, transmission is effected by means of a belt drive.

In the traversing of a thread, it is very important that the reversal points of the traversing thread guide at the ends of the traversing stroke are always located in the same place. Furthermore, it is necessary that, at the ends of a traversing stroke, the traversing thread guide is very rapidly decelerated out of a guiding speed and re-accelerated up to a guiding speed.

In order to meet these requirements, the stepping motor is operated at a higher nominal current in the stroke reversal ranges. This enables the stepping motor to generate a higher torque. Such an increase in current, in combination with a stepping frequency necessary for generation of the high acceleration and deceleration, results in an overshooting of the rotor in the stepping motor, which is directly transmitted to the traversing thread guide. This, in addition, causes the rotor to lose its stepping sequence. An increase in current requires a correspondingly powerful stepping motor. In a larger motor, however, the increase in torque generally results in a greater moment of inertia, which is disadvantageous to the attainment of the high acceleration and braking times.

By contrast, the object of the invention is to create both a method for controlling a traversing device driven by means of a stepping motor and a device in which the traversing thread guide is guided in the reversal range with an optimal capacity utilization of the stepping motor. A further aim of the invention is to drive the traversing thread guide with as little vibration as possible in the stroke reversal range.

This object is achieved, according to the invention, by a method having the features of claim 1 and by a traversing device according to the features of claim 11.

The particular advantage of the method according to the invention is that the field quantities generated in the stepping motor are used directly for controlling the traversing device. Since the method is based on the stator flux of the stepping motor, a highly dynamic closed-loop control of the drive is achieved.

The principle of the stepping motor is based on the fact that a permanent magnet type rotor rotates within a stator with several windings. For the purpose of moving the rotor, current is applied, according to a time sequence, to the windings which are offset in relation to one another. This generates magnetic fields which, in combination with the magnetic field of the rotor, render possible the movement of the rotor. The stator is formed from a plurality of windings which, as pole pairs, determine the step width of the step, ping motor. The stepping motor torque is thus determined by the magnetic flux in the stator (stator flux) and the magnetic flux in the rotor (rotor flux). Since the rotor is in the form of a permanent magnet, the rotor flux will not vary, so that the stepping motor torque is essentially influenced by the amplitude of the stator flux and the angle in relation to the rotor flux. The method according to the invention utilizes this dependence to control the movement of the rotor and, consequently, that of the traversing thread guide. For the purpose of controlling the stator flux, a stator voltage, generated by a flux control device, is predefined. The movement of the rotor is thus controlled through varying magnetic excitations with, in each case, a predefined magnetic st-stator flux in the stator windings.

There are therefore no predefined stepping motor currents. The load current will be set automatically in dependence on the working point of the stepping motor.

A particularly advantageous development of the invention provides for closed-loop control of the torque generated by the stepping motor. For this purpose, a torque regulator effects a required/actual-value comparison between an actual torque and a predefined required torque. If there is a variation, a corresponding torque correction value is generated, which is converted into the stator voltage for the purpose of controlling the stepping motor. By this means, a torque and acceleration sufficient for guiding the traversing thread guide in each position of the traversing guide can be generated in the traversing device in each case. The phase position, i.e., the angular velocity, of the rotor can be regulated by the stator voltage generated from the torque closed-loop control.

The particular advantage of the method with torque closed-loop control according to the invention is that a definite torque can be assigned in each position of the rotor. By this means, optimal capacity utilization of the stepping motor is achieved.

The torque acting on the rotor is essentially dependent on the position of the rotor, the rotor flux and the stator flux. Since the rotor has a constant rotor flux, the actual torque can be calculated, according to a particularly advantageous development of the invention, solely from the electrical parameters of stator current and stator flux. There are then two possibilities for determining the instantaneous actual stator flux of the stepping motor.

The first possibility is that the rotor position is determined without a transducer. In this case, the stator voltage and the stator current are continuously measured and combined in a computing circuit in such a way that a stator flux, dependent on the rotor position, is obtained. Using the stator flux and the stator current it is then possible to determine the actual torque, so that the ascertained actual torque can be compared with a required torque. The required torque results from the law of motion of the traversing thread guide and is known as a function of the particular winding laws. In this case, the torque can be determined in advance for each position of the rotor from the position and speed of the traversing thread guide and is input to the torque regulator.

In a particularly advantageous variant of the method, the angular position of the rotor is detected by means of a sensor and included in the closed-loop control of the stepping motor. If these position signals are brought into phase equilibrium with the rotor, a normalized rotor flux signal is obtained. These normalized rotor flux signals can be advantageously converted into corresponding stator flux signals. The stator flux is thus known.

In a preferred development of the method, the actual stator flux is continuously determined and supplied to a flux regulator for actual/required-value comparison. Such closed-loop control advantageously provides for direct correction of interfering influences. A required stator flux profile which exactly reproduces the movement of the traversing thread guide can be input to the stepping motor.

Since the phase position of the stator flux essentially influences the increase in the torque, but the amplitude of the stator flux determines the absolute value of the torque, an optimal capacity utilization of the stepping motor is achieved if flux closed-loop control is also effected in addition to the torque closed-loop control.

In this case, the station voltages produced by the regulators can advantageously be supplied directly to a pulse-width modulator for the purpose of driving a converter. All usual types of winding such as random winding, precision winding, etc. and traversing stroke changes can thus be performed with the traversing device.

Further advantageous developments of the invention are defined in the sub-claims.

Further advantages and developments of the method according to the invention are described more fully using an embodiment example, with reference to the appended drawings, wherein.

Figure 1:
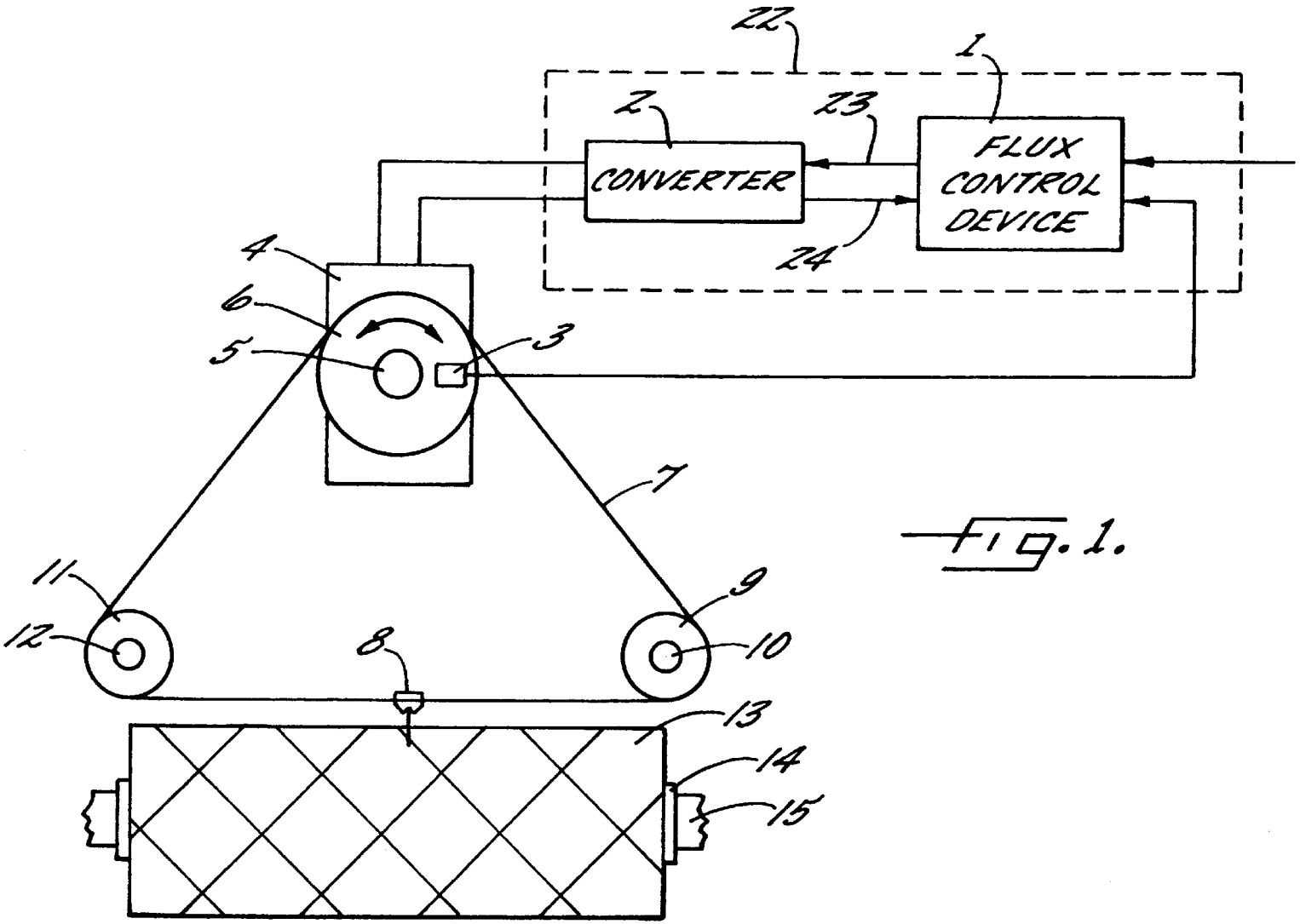
FIG. 1 is a schematic depiction of a traversing device according to the invention.

FIG. 1 is a schematic depiction of a traversing device. Here, the traversing thread guide 8 is moved to and fro within a traversing stroke by means of a stepping motor 4. The movement is transmitted from the stepping motor 4 to the thread guide 8 by means of a belt 7. The belt 7 passes around the belt pulleys 6, 9 and 11. The traversing thread guide 8 is firmly fixed to the endless belt 7 and is guided to and fro on the belt 7 between the belt pulleys 11 and 9. The belt pulley 11 is rotatably mounted on an axle 12 and the belt pulley 9 is rotatably mounted on the axle 10. The belt pulley 6 is attached to a rotor shaft 5 which is driven in alternating directions of rotation by means of a rotor of the stepping motor 4. The stepping motor 4 is driven via a control unit 22. For this purpose, the control unit 22 comprises a converter 2 and a flux control device 1. The flux control device 1 is connected to the converter 2 by means of a control line 23 and a signal line 24. The flux control device 1 is connected to a sensor 3 which senses the position of the rotor or the rotor shaft 5. The flux control device also comprises an input for the transmission of required inputs for the traversing system.

Disposed below the belt drive, in parallel to the belt 7 tensioned between the belt pulleys 9 and 11, is a winding spindle 15, to which is attached a bobbin case 14. A bobbin 13 is wound on to the case 14. For this purpose, a thread is laid to and fro along the surface of the bobbin by the traversing thread guide 8, each position of the traversing thread guide 8 being assigned to a definite angular position of the rotor in the stepping motor. The field quantities necessary for influencing the rotor can thus be input to the stepping motor 4 for each traversing thread guide position via the flux control device 1.

The operation of the stepping motor can be described as follows, with reference to the schematic representation shown In FIG. 2.

The stepping motor 4 comprises at least two windings 16 and 17, offset relative to one another by 90°. A converter 2 triggers the windings 16 and 17 alternately according to a predefined time sequence, a magnetic field with a magnetic flux $\psi_S$ building up in each of the windings. A load current (stator current) $i_S$ flows in the windings. A rotor (not shown here) mounted in the centre of the windings is then moved by its permanent magnetic field.

A sensor 3 is attached to the stepping motor for the purpose of detecting the position of the rotor. The sensor 3 is designed so that the step number of the sensor is integrally divisible by the number of pole pairs of the stepping motor. Its signal can thus be used both for closed-loop control of the position of the rotor and for determination of the stator flux. Particularly simple ratios are obtained if use is made of a toothed wheel in which the number of teeth is identical to the number of pole pairs of the motor. A sine signal and a cosine signal are obtained by means of two magnetoresistors which, to this effect, have an offset of 90° to the tooth pitch. If these signals are brought into phase equilibrium with the rotor, a normalized rotor flux signal is obtained.

Figure 3:
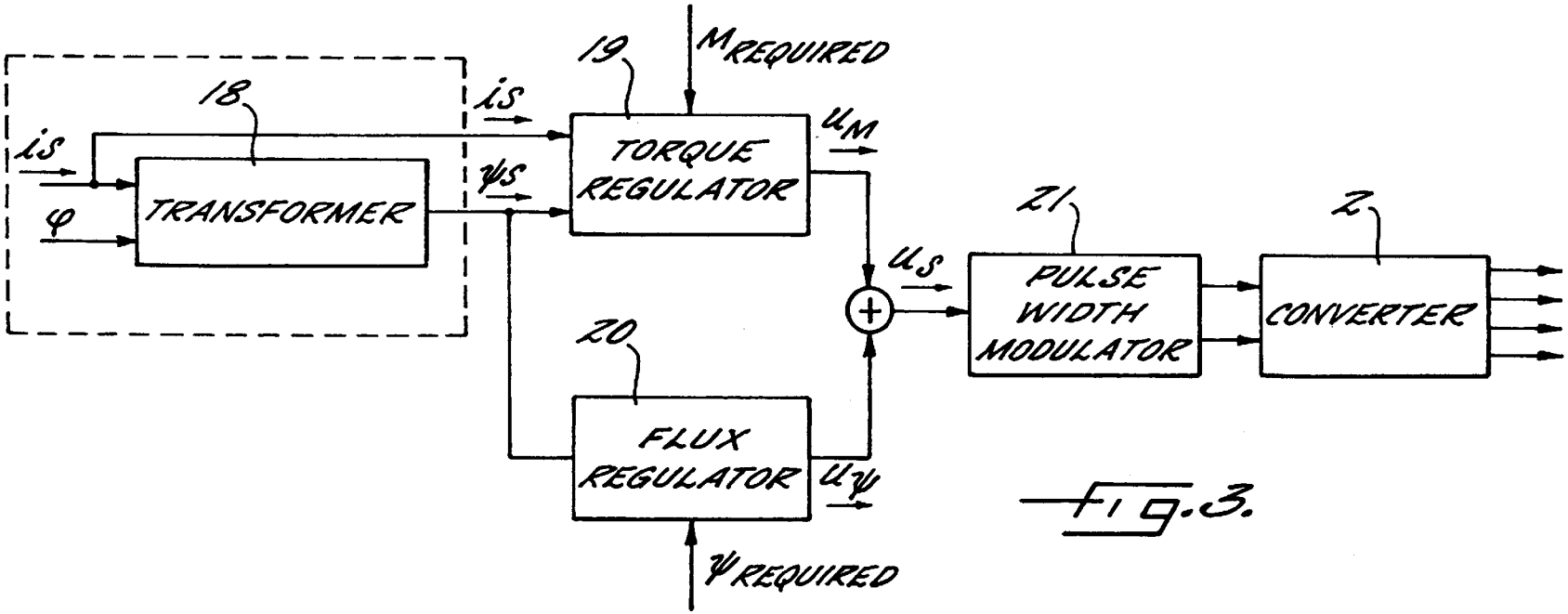
FIG. 3 shows the schematic structure of a flux control device.

The instantaneous stator current $i_S$ and the sensor signal $\phi$ are then supplied to a transformer 18 of the flux controller, as shown in FIG. 3. The flux control device is depicted schematically in FIG. 3, in which vector quantities are indicated by an arrow.

From the stator current and the sensor signal $\phi$, the transformer 18 determines an actual value of the stator flux $\psi_S$. The actual value of the stator flux is then supplied to a flux regulator 20 and, simultaneously, to a torque regulator 19. The instantaneous actual value of the stator flux is then compared, directly at the input of the flux regulator 20, with a predefined required value of the stator flux. If there is a variation, the flux regulator 20 will generate a voltage signal which is supplied to a pulse-width modulator 21 which is connected to the converter 2. In parallel with the flux closed-loop control, a comparison is made in the torque regulator 19 between a predefined required value of the torque and the actual value of the stepping motor torque. Here, the actual torque is determined from the supplied quantities of the stator current $i_S$ and stator flux $\psi_S$. If there is a variation, the torque regulator 19 likewise generates a voltage signal which is supplied to the pulse-width modulator 21. The stator voltage $u_S$ in this case is made up of a torque-forming component $u_M$ and a flux-forming component $u_{104}$, the relationship between which will be discussed in greater detail below.

Figure 4:
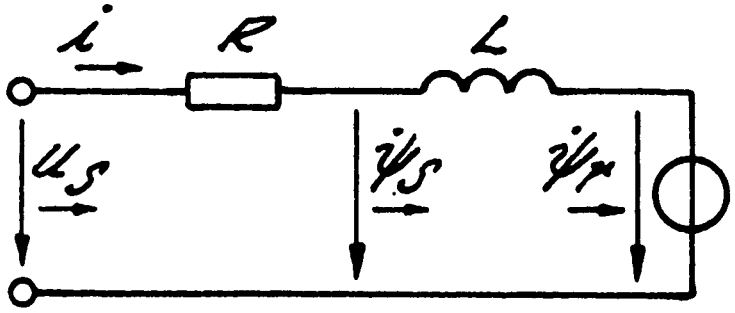
FIG. 4 shows an equivalent circuit diagram of a stepping motor.
Figure 5:
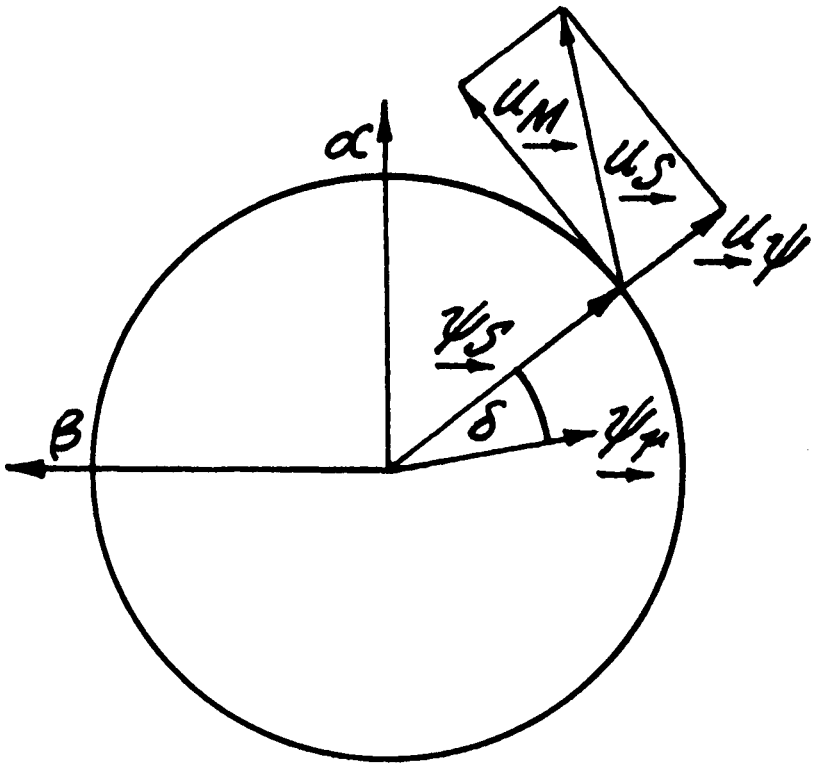
FIG. 5 shows the stator flux and rotor flux in the stator-fixed coordinate system.

The stepping motor is described further with reference to the equivalent circuit diagram shown in FIG. 4 and the vector diagram shown in FIG. 5. The machine quantities are understood as space vectors in a stator-fixed coordinate system, the $\alpha$ axis of the coordinate system coinciding with the machine winding axis and the $\beta$ axis being orthogonal to the $\alpha$ axis. The torque of a two-phase stepping motor can thus be calculated according to the following equation:

$$M=p*1/L*|\psi_S|*|\psi_R|*\sin\delta,$$

where p is the number of pole pairs of the stepping motor and $\delta$ is the angle between the stator flux space vector and the rotor flux space vector. The stator flux $\psi_S$ can be determined directly from the stator voltage $u_S$ using the following equation:

$$\psi_S=\int(u_S-i_S*R)*dt$$

By contrast, due to the permanent excitation, the amplitude of the rotor flux cannot be influenced. Its position is dependent only on the position of the rotor. In order to achieve optimal utilization of the machine, the point of the stator flux space vector should move on a circular path. This can be achieved in that a voltage space vector $u_M$ is connected to the winding whose direction is orthogonal to the direction of the stator flux. Since the stator flux $\psi^S$ is essentially an integral of the stator voltage, such a voltage space vector displaces the stator flux space vector $\psi^S$ in rotation. However, this voltage space vector alone can only influence the angular velocity $\omega$, but not the amplitude of the stator flux. A further voltage space vector $u_\psi$ is therefore required, which points in the direction of the stator flux space vector $\psi^S$ . The stator voltage $u_S$ is thus obtained as a sum of the two components $u_M$ and $u_\psi$.

For an ideal idling of the machine M=0, $\psi^S$ and $\psi_R$ must revolve congruently. If the torque is then to rise rapidly, the voltage space vector $u_M$ must be greatly increased. This immediately increases the angular velocity $\omega_S$ of the stator flux space vector, while the rotor flux space vector at first continues to revolve at its old, slower, angular velocity, due to its fixed linkage to the rotor position. The angle $\delta$ between the stator flux space vector and the rotor flux space vector and, consequently, the torque, then increases with the differential angular velocity. If the required torque reference value is attained, the voltage amplitude must be reduced again from $u_M$ to a lower value. At the same time, $u_\psi$ must be adjusted because of the increase in the voltage drop component ($i_S$*R) on the stator resistance R against the direction of $\psi^S$, due to the rise in the load current. The amplitude and phase position of the stator flux in the stepping motor can thus be determined and controlled by the stator voltage $u_S$. Following appropriate normalization, the output signal of the stator voltage can be used directly as an input signal of a pulse-width modulator. It must be noted, however, that the voltage space vector can only be influenced within the timespans in which the converter actually continues to pulse.

If determination of the stator flux is combined with position closed-loop control, the stator flux $\psi_S$ can be calculated from the following equation:

$$\psi_S=\psi_R+i_S*L$$

Figure 2:
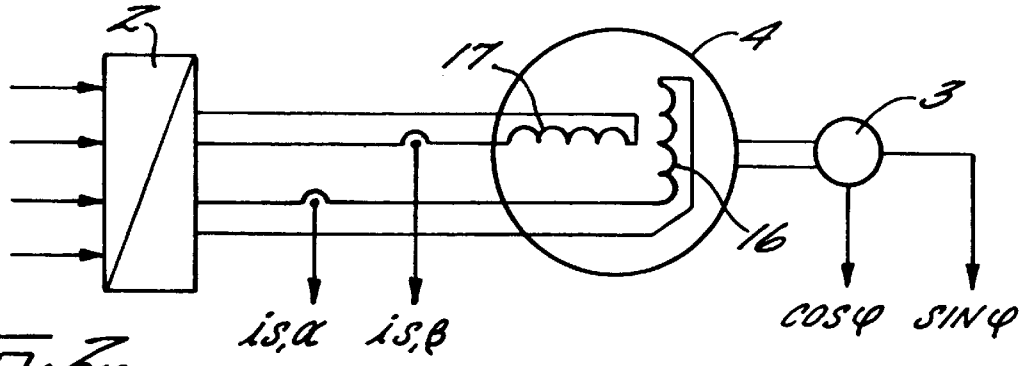
FIG. 2 is a schematic depiction of a stepping motor with two stator windings.

Using the ascertained sine and cosine rotor signals—as shown in FIG. 2—and a constant rotor flux nominal value, the following stator fluxes are obtained, relative to the stator coordinate system:

$$\psi_{S,\alpha}=\psi_0*\cos\phi+i_{S,\alpha}*L$$

$$\psi_{S,\beta}=\psi_0*\sin\phi+i_{S,\beta}*L$$

These actual values of the stator flux can then be supplied to a flux regulator or a torque regulator.

Figure 6:
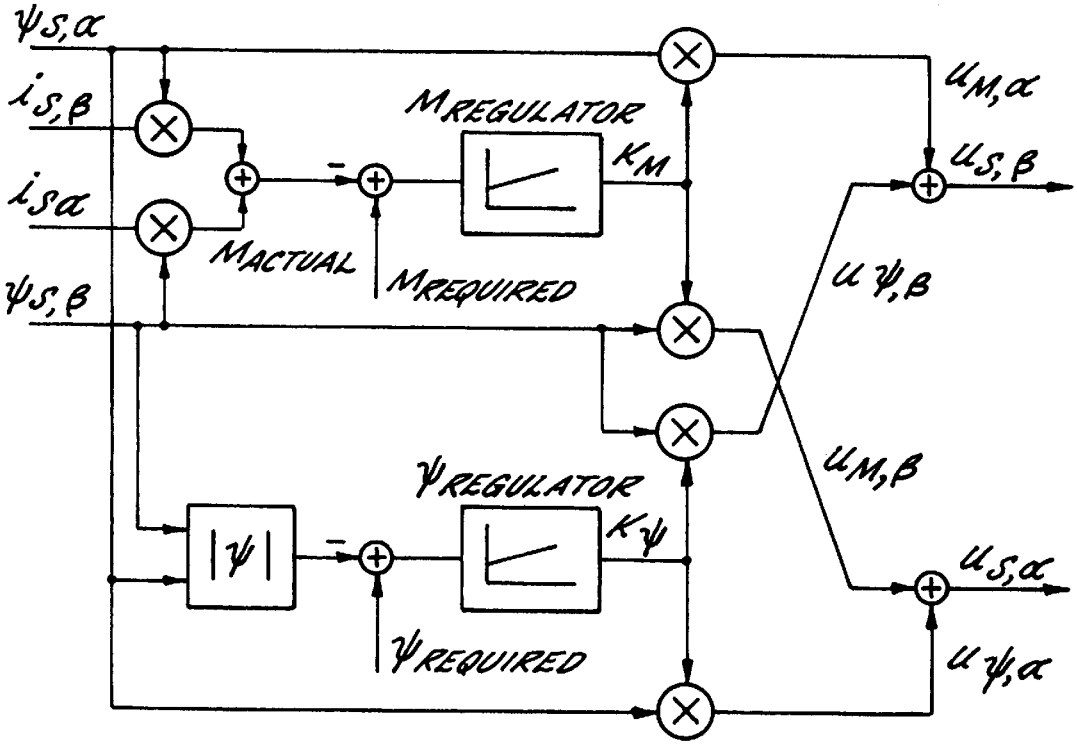
FIG. 6 shows a block diagram of the flux control device.

FIG. 6 shows a block diagram of a combined stator flux and torque regulator. Here, an actual torque is calculated as follows from the actual stator fluxes and the stator currents:

$$M=p(\psi_{S,\alpha}*i_{S,\beta})-(\psi_{S,\beta}*i_{S,\alpha})$$

The ascertained actual value of the torque is supplied to a torque regulator, which effects an actual/required-value comparison. If a variation is ascertained, a torque correction value $k_M$ is generated. By application of the relationship $u_M=jk_M*\psi_S$, the correction value is converted into a stator voltage and supplied to a pulse-width modulator for the purpose of controlling the converter.

Flux closed-loop control is effected simultaneously and in parallel with the torque closed-loop control, the stator flux being compared, following normalization, with a required stator flux regulator input. If there is a variation, the flux regulator will generate a flux correction value $k_\psi$. By application of the relationship $u_\psi=jk_\psi*\psi_S$, a voltage value is obtained which is likewise supplied to the pulse-width modulator.

By means of this closed-loop control, vibrations which frequently occur in the stepping motor in the case of rapid reversing operations can be eliminated by direct control of the motor torque, so that the traversing thread guide can be reliably guided, without vibration, in the end ranges of the traversing stroke. As a result, it is possible to achieve a much better capacity utilization of the motor than is possible with operation which generally has only open-loop control.

| LIST OF REFERENCES | |
|---|---|
| 1 | Flux controller |
| 2 | Converter |
| 3 | Sensor |
| 4 | Stepping motor |
| 5 | Rotor shaft |
| 6 | Belt pulley |
| 7 | Belt |
| 8 | Traversing thread guide |
| 9 | Belt pulley |
| 10 | Axle |
| 11 | Belt pulley |
| 12 | Axle |
| 13 | Bobbin |
| 14 | Bobbin case |
| 15 | Winding spindle |
| 16 | Winding |
| 17 | Winding |
| 18 | Transformer |
| 19 | Torque regulator |
| 20 | Flux regulator |
| 21 | Pulse-width modulator |
| 22 | Control unit |
| 23 | Control line |
| 24 | Signal line |

We claim:

1. Method for controlling a traversing device in which a traversing thread guide of the traversing device is driven to and fro within a traversing stroke by a controllable stepping motor and in which the position and the speed of the traversing thread guide is determined by a rotor of the stepping motor, the rotor moving within a stator of the stepping motor with several windings, wherein that a stator voltage is continuously generated by means of a flux control device and supplied to the stepping motor, so that the movement of the rotor is controlled by stator flux which is determined by the stator voltage.

2. Method according to claim 1, wherein that an actual torque acting on the rotor is continuously determined, that the actual torque is supplied to a torque regulator, that, following an actual/required-value comparison between the actual torque and a predefined required torque, the torque regulator generates a torque correction value and that the torque correction value is converted into the stator voltage.

3. Method according to claim 2, wherein that the actual torques is calculated, for a constant rotor flux, from a continuously measured stator current and an actual stator flux.

4. Method according to claim 3, wherein that the actual stator flux is determined from a stator voltage and the stator current by means of a computing circuit.

5. Method according to claim 3, wherein that the actual stator flux, is determined from the angular position of the rotor and the stator current, the angular position of the rotor being measured by a position sensor, and that the actual stator flux, is calculated from the sensor signal, the rotor flux and the stator current.

6. Method according to claim 2, wherein that the required torque is determined from the position and the speed of the traversing thread guide within the traversing stroke.

7. Method according to claim 1, wherein that the actual stator flux is supplied to a flux regulator, that, following an actual/required-value comparison between the actual stator flux and a required stator flux, the flux regulator generates a flux correction value and that the flux correction value is converted into the stator voltage for the purpose of controlling the stepping motor.

8. Method according to claim 1, wherein that the actual stator flux is supplied to the flux regulator, that, following an actual/required-value comparison between the actual stator flux and a required stator flux, the flux regulator generates a flux correction value for the purpose of controlling the stepping motor and that the flux correction value and the torque correction value are converted into a stator voltage.

9. Method according to claim 1, wherein that the stator voltage is supplied to a pulse-width modulator.

10. Method according to claim 1, wherein that the regulators each comprise a proportional and an integral portion.

11. Traversing device for laying a thread by means of a traversing thread guide moved to an fro within a traversing stroke, with a stepping motor which drives the traversing thread guide and with a control unit which is connected to the stepping motor and controls the stepping motor in such a way that the position and the speed of the traversing thread guide is determined by a rotor (5) of the stepping motor, wherein that the control unit has a flux control device (1) and a converter, that the flux control device (1) is connected to the converter and that the flux control device (1) generates a stator voltage and supplies the stator voltage to the converter for the purpose of controlling the stepping motor.

12. Traversing device according to claim 11, wherein that the flux control device comprises a torque regulator and/or a flux regulator whose output signals are supplied to the converter by means of a pulse-width modulator.

13. Traversing device according to claims 1, wherein that the flux control device is connected to a position sensor, disposed on the stepping motor, which detects the angular position of the rotor.

* * * * *

UNITED STATES PATENT AND TRADEMARK OFFICE

CERTIFICATE OF CORRECTION

PATENT NO. : 6,008,613

DATED : 12/28/99

INVENTOR(S) : Baader

It is certified that error appears in the above-identified patent and that said Letters Patent is hereby corrected as shown below:

Column 1, line 3, insert --BACKGROUND OF THE INVENTION--

Column 1, line 5, insert a period after "motor"

Column 1, line 6, delete entire line

Column 1, line 7-8, delete --clause of claim 11--

Column 1, line 42, change "aim" to --object--

Column 1, delete lines 45-47 and insert --SUMMARY OF THE INVENTION—

Column 3, delete lines 13 & 14 and insert --BRIEF DESCRIPTION OF THE DRAWINGS--

Column 3, line 30, insert --DETAILED DESCRIPTION OF THE PREFERRED EMBODIMENT--

Column 6, delete lines --13-34--

Signed and Sealed this

Thirtieth Day of May, 2000

*Attest:*

Q. TODD DICKINSON

*Attesting Officer*

*Director of Patents and Trademarks*